United States Patent [19]

Chandler, Jr.

[11] 4,089,064

[45] May 16, 1978

[54] PROTECTIVE ATHLETIC PANTS HOSE

[76] Inventor: Franklin Woodrow Chandler, Jr., P.O. Box 712, Reform, Ala. 35481

[21] Appl. No.: 650,563

[22] Filed: Jan. 19, 1976

[51] Int. Cl.[2] ..... A41D 13/06; A41B 9/00

[52] U.S. Cl. ..... 2/2; 2/404; 2/409; 128/80 C

[58] Field of Search ..... 2/239, 240, 2, 22, 24, 2/409, 404; 128/80 C, 165, 531, 518 R, 538, 579 R

[56] References Cited

U.S. PATENT DOCUMENTS

| | | | |
|---|---|---|---|
| 423,490 | 3/1890 | Roberts | 128/531 X |
| 3,587,572 | 6/1971 | Evans | 2/24 X |
| 3,787,892 | 1/1974 | Quinn | 2/2 |
| 3,934,583 | 1/1976 | Hollingshead et al. | 128/80 C X |

*Primary Examiner*—H. Hampton Hunter

[57] ABSTRACT

An athletic pants hose adapted and of such configuration to protect as well as support knee joints. The pants hose includes a form-fitting article formed from a lightweight elastomeric fabric material and has one set of uniquely designed articles, formed from a lightweight non-elastomeric fabric material, attached to each of the stockings. The article on each leg stocking is adapted to have a knee grip, to overlie the knee joint and adjoining leg, which will allow easy installation and no binding on knee joint when wearer desires to flex knee joint while providing sufficient tension rigidity and support for certain purposes, further including (1) an attachment from the knee grip to the waist belt to provide transfering of load from knee area to the waist through tension load on article, and holding the upper band of the knee grip for proper functioning, and (2) an attachment from the lower band of the knee grip to the stocking end at the toe cap to provide proper functioning of the knee grip with the action of the foot. The degree and location of the support being adjustable through the use of tightening of the waist belt to different positions at the waist of the wearer plus several lengths or sizes of an athletic pants hose would be adapted for several standard body figurations.

2 Claims, 2 Drawing Figures

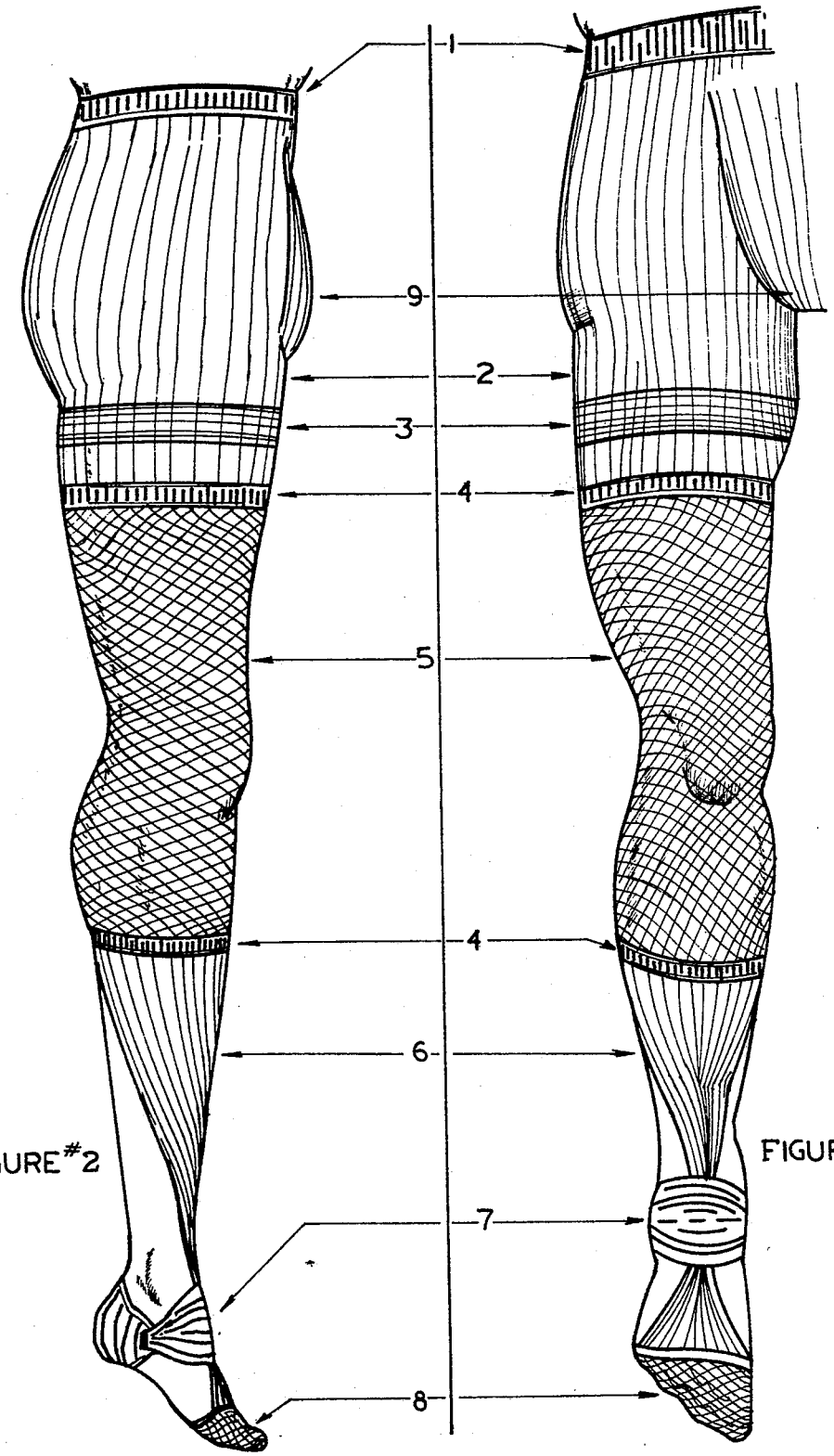
FIGURE #2
FIGURE #1

PROTECTIVE ATHLETIC PANTS HOSE

BACKGROUND OF THE INVENTION

The invention is concerned generally with a knee brace of a type adapted to support and prevent excess impact loading of an injured or weakened knee, and as well to protect a healthy knee from injury. More particularly, the invention relates to a lightweight knee brace formed from a non-elastomeric material which is cross-woven in continuous and moveable fibers from the upper to lower band of the knee brace; and may be expanded to permit positioning about the knee joint and then permitted to contract firmly to engage the wearer's knee upon extension of the knee brace by action of the wearer's foot.

Due to its delicate and complex construction, the knee joint and its associated cartilages, ligaments and tendons is susceptible to injury. One of the more common injuries incurred by those who participate in athletic activities such as skiing, skating, handball, football and the like is what is termed an over extension of the knee joint. With this particular injury, a blow to the lateral side of the joint when the individual's foot is stationary results in a twisting of the body which in turn tends to cause the upper and lower joint members to move relative to each other in a manner contrary to their normal movement upon flexing of the knee. If the twisting of relative movements occurs to a sufficient degree, severe strain is placed upon the ligaments, tendons and cartilages of the joint, resulting in serious and painful injury. It should be noted that the above-mentioned twisting movement of the body may result from a fall or other unorthodox movements and is not necessarily limited to a situation arising from a blow to the lateral side of the knee; however, in either case, there is a great deal of pain and the knee must be immobilized to permit healing, and if this is not possible or desirable, adequate support must be provided for the knee during use.

While the prior art consisted of braces that attempted to provide both adequate lateral support for the knee and protection for the kneecap, these were heavy and cumbersome. In most instances, the aforementioned braces employed uncomfortable leather straps and metal structure or framework which encircled the knee and of necessity often included a metal articulated joint; the entire arrangement being quite heavy and cumbersome. While these braces were effective with regard to the protection they afforded, their excessive weight or mass often hindered the performance of the wearer, and for this reason, often were not worn when they should have been, giving rise to the possibility of further and more serious injury to the knee joint.

On the other hand, another type of prior art brace which was less cumbersome, was constructed from a lightweight elastic fabric material. While these elastic fabric braces were comfortable and generally would not hinder the performance the wearer, they often failed to provide the requisite lateral support for the knee. Some of these were of a pants hose configuration with knee cap protection.

There were some prior art attempts to incorporate the advantages of both the elastic sleeve and the articulated metal framework; however the end result was a brace that was expensive, cumbersome, and afforded very little protection to the wearer's kneecap.

There were also prior art attempts to incorporate lightweight elastic sleeve-type braces with ribbed elastomeric material to provide protection for the kneecap. While these had afforded improved comfort, mobility, and protection; the wearer's performance was still hindered during certain movements of the legs when no protection or support of the knee joint was required. These braces also failed to provide support to the knee joint except from the immediate area of the leg adjacent to the knee joint. These braces were confining enough on the performance of the wearer as to be undesirable for the wearer with no knee problems to use.

SUMMARY OF THE INVENTION

The invention is characterized by the provision of a pants hose comprised of a one layer elastic fiber hose with overlaid functionally designed articles attached to it, said hose being adapted to be expanded and engaged over the feet, legs and hip of the wearer. The pants hose further includes a knee grip formed of cross-woven non-elastomeric material which functions by the action of the wearer's feet thereby lenghtening or shortening of the knee grip so as to provide: (1) free movement of the knee joint when needed and desired by the wearer, or (2) a tightening of the knee grip to engage the knee joint area thereby supporting the knee joint from any position change. In addition, said pants hose utilizes non-elastic fabric material to hold the upper end of the knee grip in the same relative position to the legs during use by wearer and to also provide the functioning connection from the lower end of the knee grip to the wearer's feet.

Accordingly, in view of the above discussion of prior art, it is an object of the present invention to provide a knee brace which can be manufactured from lightweight elastomeric and non-elastomeric fabric material which affords improved convenience, mobility, and protection achieved by the prior art elastic-type braces and molded sleeve with flexible stays-type braces.

Still another object of the invention is to achieve additional support, for the knee joint, over that achieved by prior art braces and this additional support is achieved in that the knee grip is supported by a tension load in the fiber connecting material to the waist belt and the toe cap on the feet. The knee joint thus receives support from the wearer's body other than the immediate area of the knee joint.

DESCRIPTION OF THE ILLUSTRATED EMBODIMENT

FIG. 1 is a perspective side view of the Protective Athletic Pants Hose of the present invention positioned on the body of the wearer.

FIG. 2 is a perspective front view of the Protective Athletic Pants Hose of the present invention positioned on the body of the wearer.

DESCRIPTION OF THE PREFERRED EMBODIMENT

Referring now to the drawings wherein like reference characters denote corresponding parts, FIG. 1 illustrates the Protective Athletic Pants Hose positioned on the body of the wearer. Looking now to the specific construction of the Protective Athletic Pants Hose, pants hose base 3 is comprised of one or more layers of elastic fiber material which forms the base for the other items of this hose. While the various other items of this hose may be either fitted upon the pants hose base 3 or formed into the pants hose base 3. The purpose of the pants hose base 3 will remain the same and that purpose will be to (1) make the hose such that it is easily installed by the wearer, (2) firmly hold the other items of the pants hose to the wearer's body, and (3) allow proper movement and function of the knee grip 5.

As shown in FIGS. 1 and 2, the knee grip 5 serves the most important functions and employs nonelastic cords woven in a continuous manner such that each cord makes one and one half rotations ( or a multiple thereof) around the leg in connecting the upper and lower connecting bands 4. During manufacture the knee grip 5 may be viewed from either end as a cylinder formed by half of the above said cords rotated in a clockwise direction and interlaced with the other half of the cords rotated in a counterclockwise direction. The design of the knee grip 5 is such that when the distance between the upper and lower connecting bands 4 increases the diameter of the knee grip 5 decreases. The design is also such that it accomodates flexing of the knee joint without the diameter of the knee grip 5 changing when the upper and lower connecting bands 4 stay in the same relative position on the legs. The above mentioned upper and lower connecting bands 4 shall function to bind the knee grip 5, the upper stationary holder 2, and the lower action holder 6. The knee grip 5 receives assistance from the elastic pants hose base 3 in that when the force separating the upper and lower connecting bands 4 is reducing, the elastic pants hose base 3 pulls the knee grip 5 together, thereby increasing the knee grip 5 diameter.

Turning now to the upper half of the Protective Athletic Pants Hose shown in FIGS. 1 and 2, we see that the upper stationary holder 2 on each leg consists of nonelastic connecting cords which prevent any noticeable lengthening of the hose between the waist belt 1 and the upper connecting band 4. The upper stationary holder 2 shall be strong enough to carry any possible tension load put upon them in athletic activity. The waist belt 1 is a nonelastic belt which can be made snug to the waist by the wearer and this waist belt 1 is to be positioned by the wearer such that proper action and support is received from the knee grip 5 during athletic activity. The crotch section 9, which is the last item in this part of the hose is made of an elastic material which is sized to provide wearer comfort and to bind the two leg sections together.

Turning now to the lower half of the Protective Athletic Pants Hose shown in FIGS. 1 and 2, we see that the lower action holder 6 on each leg consists of nonelastic connecting cords which connect the lower connecting band 4 to the toe cap 8 and the lower action holder 6 moves with the movement of the wearer's feet. The lower action holder 6 fits under the ankle guide 7 which allows movement of the lower action holder 6 along the surface of the leg but constrains it to the leg surface, the ankle guide 7 and the toe cap 8 are made of nonelastic material of such strength as to be durable during athletic activity.

The material from which the garment of the present invention is constructed can be any suitable material having the desired properties and characteristics required. In general, such material may be any natural or synthetic material, typical examples of which are cotton, nylon, polyesters, blends or mixtures of such materials. The material per se may be of a woven, nonwoven or knitted construction.

As will be apparent to those skilled in the art, the illustrated embodiment may be modified without departing from the spirit and scope of the invention. Accordingly, the disclosed embodiments are to be considered as illustrative rather than restrictive, the scope of the invention being defined by the appended claim.

1. A pants type hose garment having knee joint support devices; said garment comprising at least one layer of elastic fabric formed of a contractile material and adapted to be expanded and engaged over the hips and legs of the wearer; said garment having functional items for support of the knee joint on the leg portions of said hose and including a knee grip positioned to overlie and support the knee joint and adjoining leg connections, said knee grip including an upper connecting band positioned above the knee, a lower connecting band positioned below the knee and a plurality of inelastic cords extending between and connected to each of said connecting bands, a number of said inelastic cords extending in a clockwise direction from their points of connection with one of said connecting bands for a distance of one and one-half times around the circumference of the knee grip to the points of connection at the other connecting band, a substantilly equal number of said inelastic cords extending in a counterclockwise direction for the same distance and being interlaced with said clockwise extending cords, whereby when the distance between the connecting bands comprising the ends of the knee grip decreases the diameter of the knee grip increases or vice versa; a waistband; inelastic substantially vertically extending connecting cords extending between and connected to said waistband and said upper connecting band for holding said upper connecting band in the same relative position on the wearers legs; a foot portion on each leg portion including a toe cap; inelastic substantilly parallel and vertically extending connecting cords in said elastic fabric layer extending between and connected to said toe caps and said lower connecting bands, whereby movement of the wearers feet operate to move said lower connecting bands along the length of the wearers legs to continuously constrain the knee grip into engagement with the knee joint.

2. A garment as defined in claim 1 wherein said knee grip before application on the wearer is in a shortened length or expanded cylinder diameter position such that the knee grip may be easily installed and engaged on the knee joint.

* * * * *